United States Patent [19]

Lesster et al.

[11] 4,303,902

[45] Dec. 1, 1981

[54] INDUCTIVE COUPLER

[75] Inventors: Laban E. Lesster, Crofton; Everett W. Opdahl, Lutherville, both of Md.

[73] Assignee: Westinghouse Electric Corp., Pittsburgh, Pa.

[21] Appl. No.: 71,633

[22] Filed: Aug. 31, 1979

[51] Int. Cl.[3] ..... H01F 15/02; H01F 23/00

[52] U.S. Cl. ..... 336/83; 336/92; 336/212; 336/DIG. 2

[58] Field of Search ..... 336/DIG. 2, 234, 120, 336/83, 212, 90, 92

[56] References Cited

U.S. PATENT DOCUMENTS

| | | | |
|---|---|---|---|
| 2,483,815 | 10/1949 | Easton | 336/DIG. 2 |
| 2,624,783 | 1/1953 | Nedzel | 336/120 X |
| 3,317,874 | 5/1967 | Honsinger | 336/83 X |
| 3,328,735 | 6/1967 | Honsinger | 336/234 X |
| 3,441,887 | 4/1969 | Costa | 336/120 X |
| 3,534,310 | 10/1970 | Pelissier | 336/83 |
| 3,550,682 | 12/1970 | Fowler | 336/DIG. 2 |
| 3,682,098 | 8/1972 | Spies | 336/DIG. 2 |
| 3,743,989 | 7/1973 | Niedas et al. | 336/DIG. 2 X |
| 4,038,624 | 7/1977 | Namba et al. | 336/120 X |

FOREIGN PATENT DOCUMENTS

| | | | |
|---|---|---|---|
| 2402069 | 7/1974 | Fed. Rep. of Germany | 336/DIG. 2 |
| 1497581 | 10/1967 | France | 336/DIG. 2 |
| 1366134 | 9/1974 | United Kingdom | 336/DIG. 2 |

*Primary Examiner*—Thomas J. Kozma
*Attorney, Agent, or Firm*—D. Schron

[57] ABSTRACT

A coaxial inductive coupler having an inner magnetic core member and a surrounding outer magnetic core member each having respective windings. The inner magnetic core is operatively carried by an inner support assembly which is additionally connected to an outer protective shell. The outer core is disposed within a cylinder having at the end thereof a large guide member for facilitating insertion into the outer protective shell. A locking mechanism is provided to insure positive coupling and easy release.

10 Claims, 10 Drawing Figures

INDUCTIVE COUPLER

CROSS REFERENCE TO RELATED APPLICATIONS

This application is related in subject matter to application Ser. No. 71,634, filed concurrently herewith and assigned to the same assignee as the present invention.

BACKGROUND OF THE INVENTION

1. Field of the Invention

The invention in general relates to signal and/or power coupling devices, and more particularly to one of the inductive coupler variety.

2. Description of the Prior Art

Inductive couplers for coupling power from a source to a load are used in environments where the ambient medium dictates against normal exposed metal-to-metal contact. For example, such couplers are utilized to prevent sparks in an explosive atmosphere and find a wide use in the off-shore oil industry or other underwater operations for making circuit-to-circuit connections beneath the surface of the water.

The inductive coupler device is based upon the alternating current transformer principle, that is, by means of electromagnetic induction a voltage is induced from a primary winding to a secondary winding with the aid of a magnetic circuit without making any physical electrical connections. In its simplest form, one type of inductive coupler utilizes two C cores representing a magnetic circuit each having a respective winding and when the respective end sections of the two C cores are brought together, a basic transformer is formed. With the application of proper electrical insulating and corrosion protecting materials, the connector may be utilized as the electrical interface between submerged components.

When utilized for signal or data transfer, these face-to-face couplers if separated by a relatively small gap exhibit an unacceptable degradation of overall frequency response.

Another type of coupler such as described in British Pat. No. 1,366,134 has been propsed for power transfer and is made up of an outer magnetic section with a winding, into which is coaxially located an inner magnetic circuit with a winding. A source of electrical power is connected to the outer winding, which constitutes a primary, and a load circuit is connected to the inner winding constituting a secondary. With such arrangement, when the inner winding is removed, the primary current increases to such an extent that a plug part must be inserted into the open socket from which the inner section was removed so as to prevent the primary circuit from burning out. Alternatively, it is proposed to provide a complete auxiliary electric circuit comprised of a plurality of inductive and capacitive elements so as to form a tuned circuit with the primary winding. Thus when the secondary is removed upon decoupling, the circuitry becomes detuned such that the primary current is appreciably lowered.

The present invention is of this coaxial variety and completely eliminates the need for auxiliary plugs or auxiliary electrical circuit components required for a tuned circuit.

Another type of coaxial coupler utilizes primary and secondary coaxial windings inductively coupled to one another without the benefit of a closed magnetic core circuit. Although power in such couplers is provided to the inner winding constituting a primary, there is very poor coupling and the design is relatively inefficient.

Still other types of coaxial couplers which include closed magnetic circuits have mating tapered surfaces. When utilized in an underwater environment, where dirt, algae, and marine growth for example may contact the surfaces of the mating parts, proper operation is severely degraded due to axial misalignment.

The coaxial coupler of the present invention is of such design to allow for a relatively high degree of axial misalignment while still maintaining proper operation for not only power transfer but for data transfer. Further, the structure of the coupler is such as to facilitate coupling and uncoupling even in an underwater environment where visibility may be impaired.

SUMMARY OF THE INVENTION

The inductive coupler of the present invention includes a first support assembly having an elongated rod portion which carries a first magnetic flux supporting elongated core member. The core member has first and second end portions with a central portion therebetween and around which is wound a first winding.

A second and generally hollow cylindrical support assembly is provided for supporting a second magnetic flux supporting core member which is positioned around the inner surface of the second support assembly. The second core is of a generally hollow cylindrical shape and includes first and second end portions and the central portion with a second winding being positioned around the inner surface of the central portion. The core members are relatively mateable such that the first and second end portions of the first core member are in magnetic flux registration with respective end portions of the second core member. An outer cylindrical protective shell surrounds both the first and second core members when in a mated condition and means are provided for locking the coupler when in a mated condition.

DESCRIPTION OF THE PREFERRED EMBODIMENTS

Figure 1:
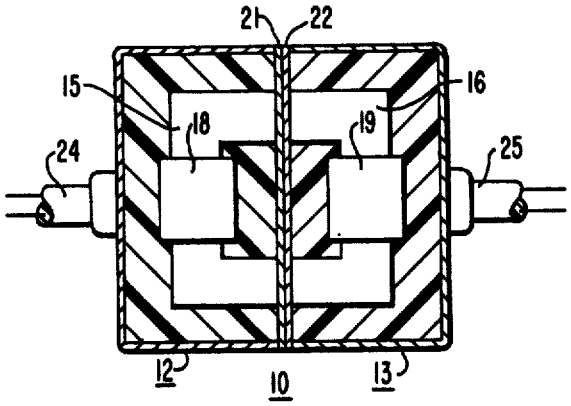
FIG. 1 PRIOR ART
FIG. 1 is a view, partially in section, of a prior art face-to-face inductive coupler.

Referring now to FIG. 1, there is shown a typical prior art face-to-face inductive coupler. The coupler 10 is comprised of two housing parts 12 and 13 each including a respective C-shaped core member 15 and 16 having respective windings 18 and 19. Stainless steel cover plates 21 and 22 protect the core members from the ambient medium such as an underwater environment.

Figure 2:
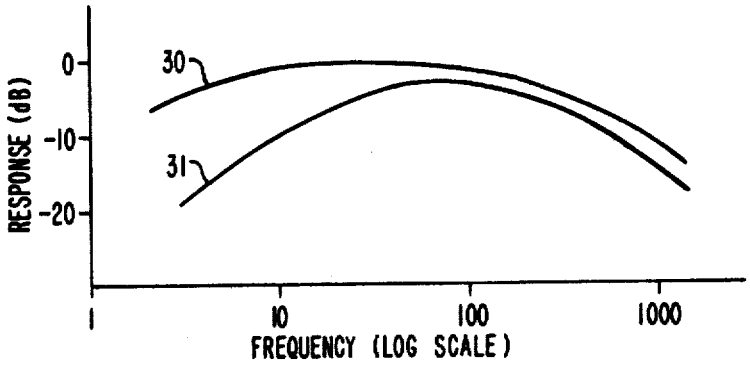
FIG. 2 are curves illustrating the performance of the coupler of FIG. 1.

Windings 18 and 19 are electrically connected to respective cables 24 and 25 which in one typical use convey data or information signals. Such couplers are extremely sensitive to variations in frequency response due to relative separation of the two mating portions 12 and 13. For example, in FIG. 2, curve 30 illustrates a typical frequency response with no gap between the mated portions. Curve 31 illustrates the degraded response if the housing parts are separated by a distance of 0.031 inch (0.0787 cm). The curves illustrate that at 100 kilohertz (kHz), there is an approximately 2 dB reduction in response, however, at the lower frequencies, the difference is significantly greater.

Figure 3:
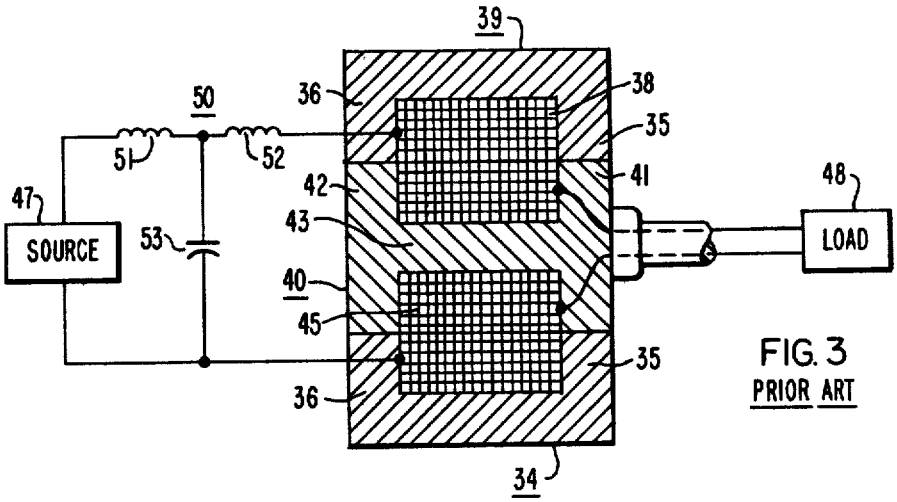
FIG. 3 PRIOR ART
FIG. 3 is a view of another prior art inductive coupler.

Another type of prior art inductive coupler which has been proposed for use in an explosive atmosphere is illustrated in FIG. 3 in cross-section and includes an outer cylindrical member 34 having radially inwardly-extending flanges 35 and 36 at each end whereby a winding 38 is fixed in the interior of the cylinder. The other core member 40 includes two end discs 41 and 42 joined by a cylindrical center limb 43, the arrangement carrying winding 45.

The coupler is used to transfer power from a source 47 to a load 48, with the source being connected to winding 38, constituting the primary, and the load being connected to winding 45, constituting the secondary of the inductive coupling arrangement.

With such arrangement, when the core member 40 is withdrawn from core member 34 to effect a disconnection, there is an objectionable increase in the primary current so as to require insertion of an auxiliary element to replace the removed core.

In lieu of the requirement for insertion of a separate plug, the arrangement of FIG. 3 may include an auxiliary circuit 50 comprised of an inductor 51 in series with the parallel arrangement of inductor 52 and capacitor 53, inductor 52 being connected to the primary winding 38. The values of the inductances and capacitance are such that when the core member 40 is inserted within core member 34, the primary circuit is tuned to the supply frequency and when the core member 40 is removed, the circuit is no longer tuned so as to substantially reduce and limit the current in the primary circuit.

The inductor of the present invention is of the variety illustrated in FIG. 3, however, when used for such power transfer it completely eliminates the requirement for either a separate insertable plug or a separate auxiliary circuit to protect the primary.

Figure 4:
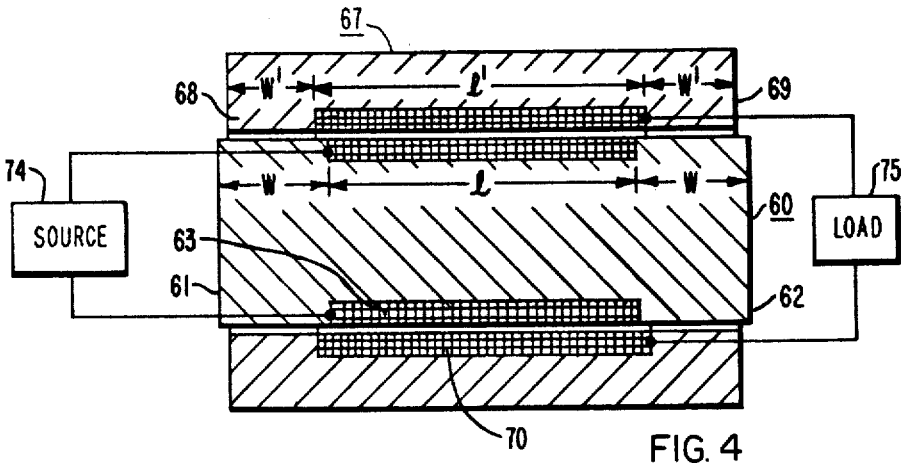
FIG. 4 is a simplified view of the coupler of the present invention utilized in a power coupling situation.

FIG. 4 basically illustrates the concept of power transfer with the present invention. The inductive coupler of FIG. 4 includes an inner core member 60 having enlarged end portions 61 and 62 each of an axial length W, and winding 63 of length l therebetween. Disposed coaxially about the inner core member is a generally cylindrical outer core member 67 having inwardly extending end portions 68 and 69 each of an axial length W' containing a winding 70 of length l' therebetween. The unequal axial lengths of the end portions and windings will permit limited relative axial movement of the inner and outer core members in response to axial forces on the coupler without any accompanying change in performance.

The end portions of members 60 and 67 are in magnetic flux registration and means are provided for connecting the inner winding 63 to a source of electrical power 74 and for connecting the outer winding 70 to a load 75. It is to be noted that this arrangement of connecting the source to the inner winding and the load to the outer winding is in direct contrast to that proposed by the prior art of FIG. 3.

Figure 5:
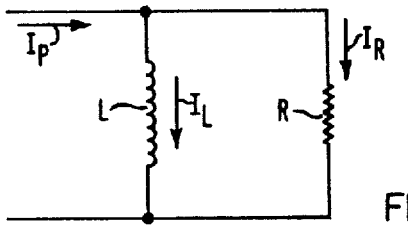
FIG. 5 is a circuit to illustrate the currents in the primary winding of the inductive coupler.

A simplified equivalent circuit of the primary winding is illustrated in FIG. 5 and includes the parallel arrangement of an inductor L and resistor R. The primary current is $I_P$, which is comprised of the magnetizing current $I_L$ through inductor L, and the reflected load current $I_R$ through resistor R.

Figure 6:
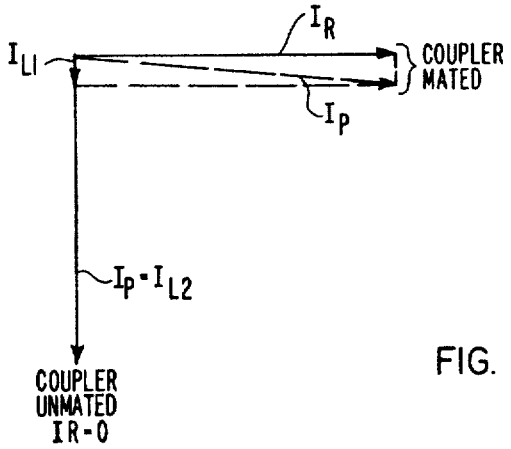
FIG. 6 is a vector diagram illustrating certain current relationships.
Figure 7:
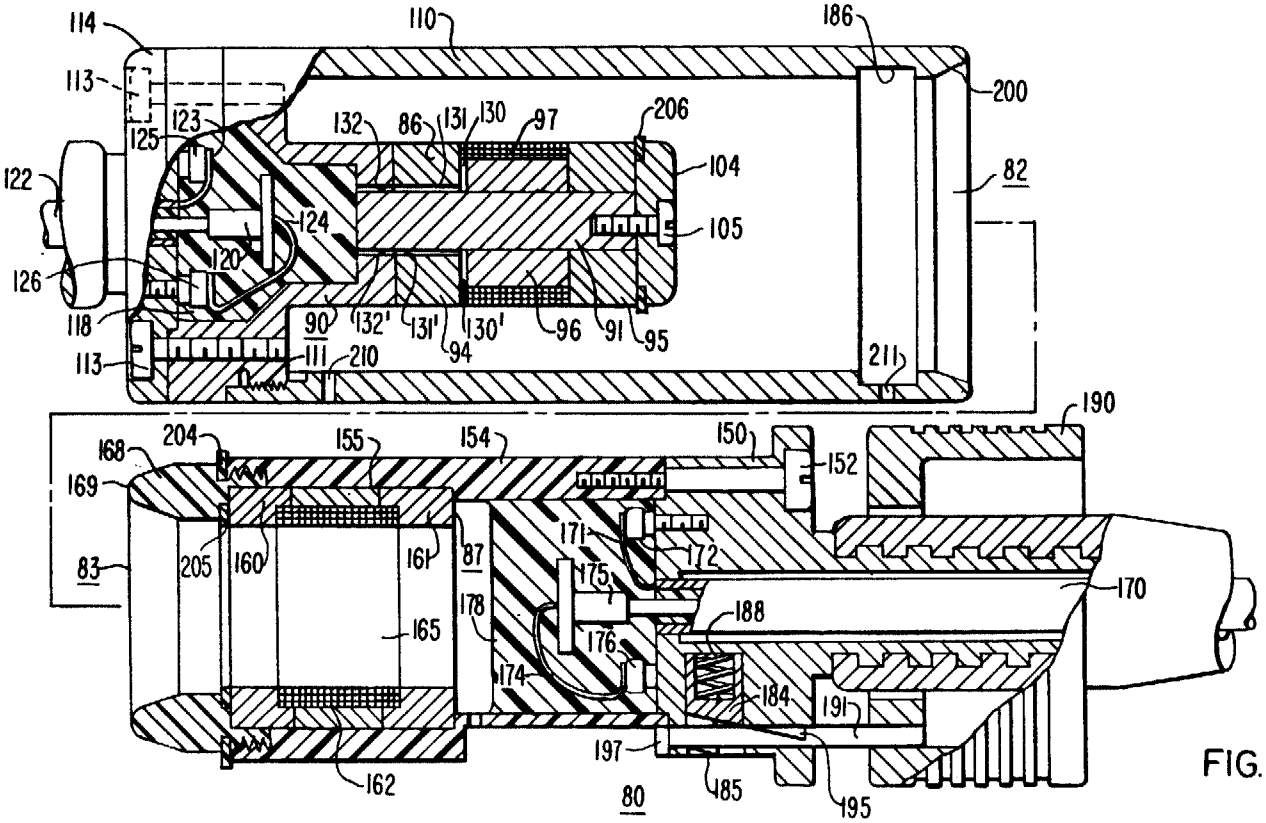
FIG. 7 is an axial cross-sectional view of a preferred embodiment of the present invention, the coupler being in an unmated condition.

FIG. 6 illustrates a vector diagram of the currents illustrated in FIG. 5. Vector $I_R$ represents the reflected load current and vector $I_{L1}$ represents the magnetizing current through inductor L. $I_P$ therefore is the resultant primary current. In a preferred embodiment, the core members would be made of a ferrite and accordingly any core loss current would be minimal and for clarity has not been illustrated. When the coupler is unmated, there is no reflected load current and the total primary current is the current through the inductor L, designated as vector $I_{L2}$ in FIG. 6.

The inner or primary winding 63 has a certain inductance $L_M$ when in a mated condition and a different and much lower inductance $L_U$ when in an unmated condition. If the ratio of reflected load current to magnetizing current ($I_R/I_{L1}$) is designed to be the same as the ratio of $L_M/L_U$, then the primary current will not significantly change in amplitude, but will remain essentially constant from the mated to the unmated condition of the inductive coupler. Thus, in FIG. 6, the vector $I_P$ when the coupler is in a mated condition is approximately the same magnitude as vector $I_{L2}$, which is the primary current when the coupler is in an unmated condition. By way of example in one test set-up, for a coupler with 40 turns of primary and secondary winding, with a ferrite core member, the inductance of the winding of the inner core when in a mated condition was in the order of 4.8 millihenries, and 360 microhenries when in an unmated condition. These values yield a ratio of $L_M/L_U = 13.3/1$.

As a practical matter, this ratio 13.3/1 would be somewhat higher than desired for a ratio of reflected load current to magnetization current since it would require more primary turns thus causing an increase in copper losses resulting in a somewhat more inefficient unit. Accordingly, the ratio of reflected load current to magnetization current is chosen to be in the order of 5/1. Since this is not the exact ratio of $L_M/L_U$, the current in the primary will go up somewhat when the unit is uncoupled, but it will go up only approximately $2\frac{1}{2}$ times ($13.3 \div 5 = 2.6$), which is more than acceptable, and in fact an increase of primary current of approximately 5 times that in a mated condition would still give satisfactory results.

FIG. 4 illustrated the principles of one embodiment of the present invention for the simplistic showing of a coaxial coupler. Another embodiment of an actual coupler in accordance with the teachings of the present invention is illustrated in the views of FIGS. 7 through 10 to which reference is now made. The coupler 80 is comprised of two mating sections 82 and 83, the section 82 containing an inner core member 86 and section 83 containing an outer core member 87. An inner support assembly 90 includes an elongated rod portion 91 upon which is mounted the inner core member 86. For ease of manufacture, the inner core member, preferably of a magnetic flux supporting ferrite is comprised of three separate pieces, end pieces 94 and 95 and a central piece 96 around which is wound a number of turns of primary winding 97. The entire assembly is maintained in position by means of a retaining cap 104 affixed to rod portion 91 by means of screw 105.

An outer protective shell 110 is threadedly engaged at 111 with the inner support assembly 90 to which end cap 114 is also connected, by means of screws 113. End cap 114 in conjunction with the inner support assembly 90 defines an internal cavity 118 in which is located an anchor member 120 preferably held in position by filling the internal cavity 118 with a resin such as polyurethane.

The electrical cable 122 is of the coaxial variety which is brought through the end cap 114, and thereafter the outer shield 123 and inner conductor 124 are connected to respective stand-offs 125 and 126, with the inner conductor 124 passing through the anchor member 120. One end of winding 97 is connected to stand-off 125 by the path which includes groove 130 in ferrite piece 97, through groove 131 in end piece 94 and through aperture 132 in inner support assembly 90. The other end of winding 97 is connected to the other stand-off 126 by the path which includes grooves 130' and 131' and aperture 132'.

Mating section 83 includes an end cap 150 to which is connected, by means of screws 152, an inner cylinder 154 made of a plastic material such as delrin, and having a groove 155 on the inner surface thereof designed to accommodate the outer magnetic core member 87 and limit its degree of insertion.

For ease of manufacture, the outer magnetic core member 87 is fabricated in three pieces, two end pieces 160 and 161 having end portions which extend radially in toward the center of the unit, and a central portion 162, with winding 165 being contained between end sections 160 and 161. The magnetic section is held in position by means of a large guide member 168 threadedly engaged to the end of the inner cylinder 154 and having a generally tapered and rounded end portion 169 for ease of insertion into the outer protective shell 110 and to limit movement of the outer core member 87.

In a manner similar to cable 122, cable 170 has its outer shield 171 connected to a stand-off 172 while its inner conductor 174 passes through an anchor member 175 and is connected to stand-off 176. Anchor member 175 is held in position by means of a potting material 178, such as polyurethane. One end of winding 165 is then connected to stand-off 172 while the other end of the winding is connected to stand-off 176.

Figure 8:
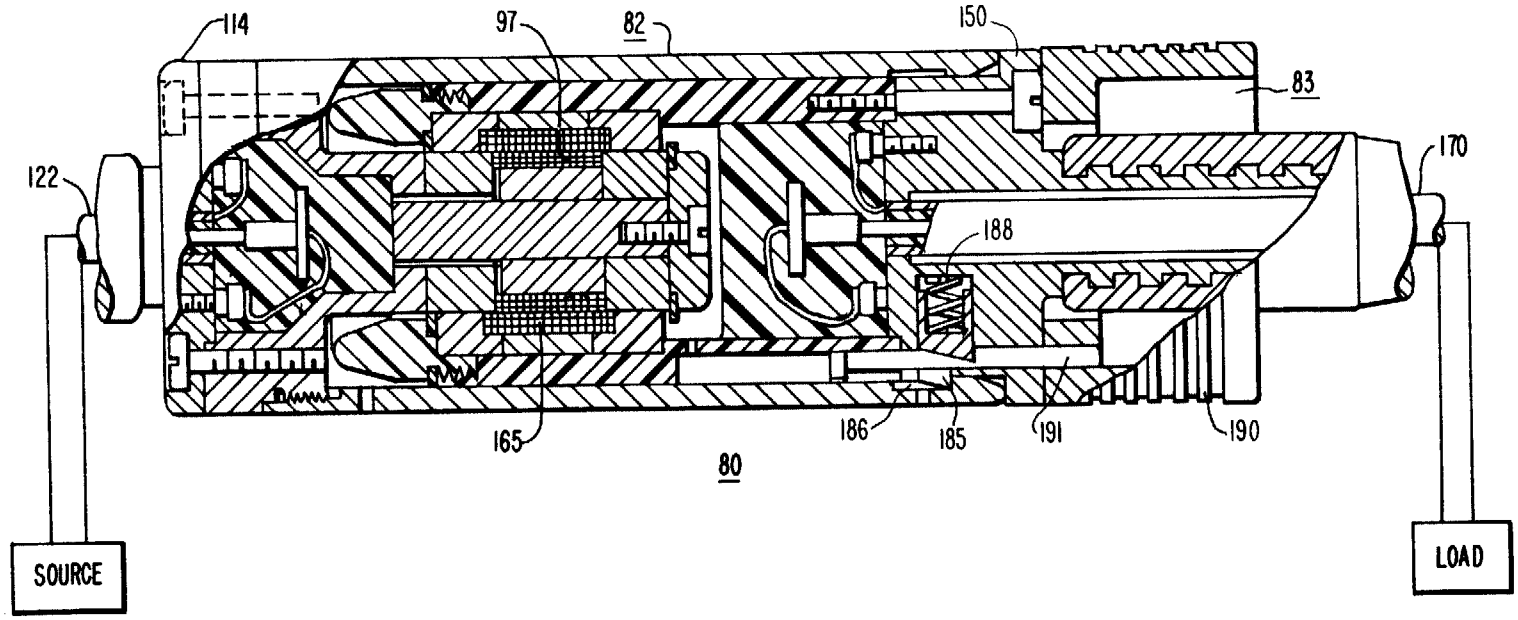
FIG. 8 is an axial cross-sectional view of a preferred embodiment of the present invention, the coupler being in a mated condition.
Figure 9:
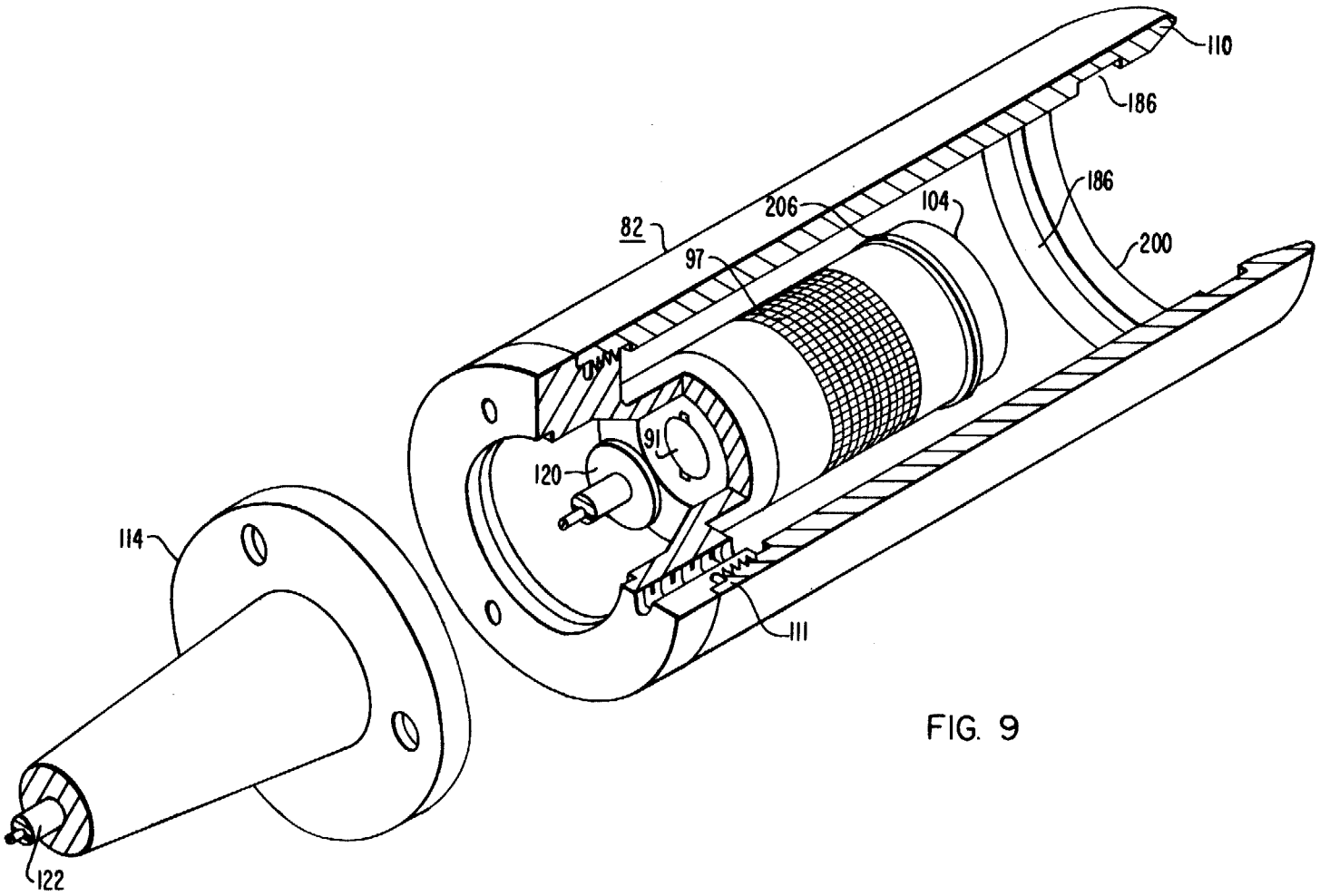
FIGS. 9 and 10 are exploded isometric views, with portions broken away, of the coupler of FIG. 7.
Figure 10:
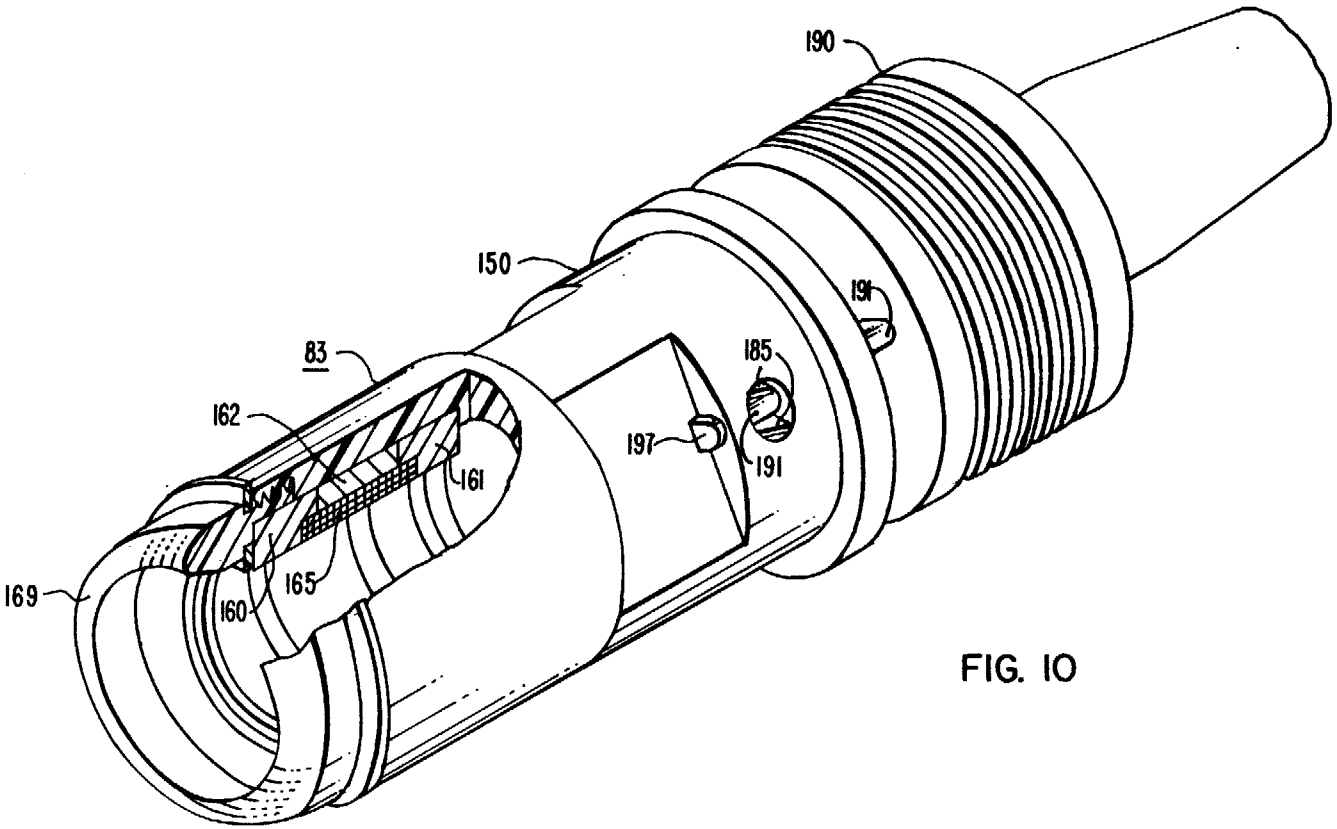

In order to maintain sections 82 and 83 in a locked condition when they are mated, there is provided a plurality of latches 184 disposed within recesses in end cap 150. As seen in FIG. 8, the projection portion 185 of latch 184 sits within a groove 186 on the inside of the outer protective shell 110, and is maintained in that position under the action of spring 188. With this arrangement, the two mating portions will not become uncoupled merely by pulling on respective cables 122 and 170. In order to decouple the mating sections, there is provided a release cup 190 to which is connected a plurality of release rods 191 passing through respective apertures in end cap 150. The release rods include an indented or cam surface 195 and when the release cup 190 is pulled, the camming action of the surface of latch member 184 which engages the cam surface 195 causes the latch member 184 to be withdrawn further into its recess thus pulling the projection 185 out of engagement with groove 186 to thereby effect a decoupling of the mating sections 82 and 83. Movement of the release cup 190 is limited by means of the projection 197 at the end of release rod 191. If the release cup 190 is maintained in its extended position, then latch 184 is maintained in its recessed condition so that the two sections may be mated, after which release cup 190 is moved to the position illustrated in FIG. 8 to effect a locking of the two pieces.

If, on the other hand, while in an unmated condition, release cup 190 is pushed forward so that latch 184 seats on the sloping surface 195 of release rod 191, then coupling and locking may still be effected by virtue of the sloping surface 200 on the inner surface of outer protective shell 110 which forms a camming surface for projection 185 of latch 184 to force it into its recess so that the coupler may assume the relationship of FIG. 8.

When the coupler is used in an underwater environment, there is a possibility that foreign matter may enter the cavities when in an unmated condition. Such foreign matter, for example, may include dirt, sand, algae, etc. Accordingly, provision is made for wiping the inner surface of outer protective shell 110 and the surfaces of the exposed magnetic pieces. This is accomplished with the provision of washers or rings 204 and 205 positioned between inner cylinder 154 and the large guide member 168, as well as a similar washer 206 located around rod 91 and held in position by means of retaining cap 104. These washers preferably are made of a rubber material which prevents fouling in the coupling, one example being "NO FOUL", a product of the B. F. Goodrich Co. Since washer 204 is in tight engagement with the inner surface of outer shell 154, apertures 210 and 211 are provided in the shell so as to provide bleed holes for water when the mating sections are coupled and uncoupled, respectively.

What we claim is:

1. Inductive coupler apparatus comprising:

(A) a first support assembly including an elongated rod portion having a free end;

(B) a first magnetic flux supporting elongated core member extending around and carried by said rod portion, and including first and second end portions and a central portion joining said end portions;

(C) retaining means coupled to said free end of said rod portion to maintain said first core member in position;

(D) a first winding positioned around said central portion;

(E) a second and generally hollow cylindrical support assembly;

(F) a second magnetic flux supporting core member positioned around the inner surface of said second support assembly, and being of a generally hollow cylindrical shape and including first and second end portions and a central portion joining said end portions;

(G) means coupled to said generally hollow cylindrical support assembly to maintain said second core member in position;

(H) a second winding positioned around the inner surface of said central portion;

(I) said first core member being matable within said second core member such that said first and second end portions of said first core member are in magnetic flux registration with respective end portions of said second core member;

(J) an outer cylindrical protective shell surrounding both said first and second core members when in a mated condition; and (K) said protective shell being carried by said first support assembly and being of a length to extend past said free end of said rod portion.

2. Apparatus according to claim 1 wherein:

(A) said means coupled to said generally hollow cylindrical support assembly is a guide member connected to an end thereof and having a generally tapered and rounded end portion to facilitate insertion into said protective shell.

3. Apparatus according to claim 1 wherein:

(A) said first core member is comprised of a plurality of pieces of flux supporting material.

4. Apparatus according to claim 3 wherein:

(A) each of said first and second end portions and said central portion of said first core member are of individual pieces of said material.

5. Apparatus according to claim 4 wherein:

(A) said portions are in the form of annular discs the outer diameter of said end portions being greater than that of said central portion.

6. Apparatus according to claim 1 wherein:

(A) said generally hollow cylindrical support assembly includes a groove in the internal surface thereof for receiving said second core member and extending for an axial length at least equal to the axial length of said second core member for limiting the degree of insertion of said second core member.

7. Apparatus according to claim 2 wherein:

(A) said guide member being coupled to said second core member and including means to limit the movement thereof relative to said generally hollow cylindrical support assembly.

8. Apparatus according to claim 1 which includes:

(A) means for locking said coupler when in a mated condition;

(B) an axially movable release mechanism coupled to said means for locking to unlock said coupler;

(C) said release mechanism being constructed and arranged to effect said unlocking when pulled in an axial direction.

9. Apparatus according to claim 1 which includes:

(A) means for wiping the inner surface of said outer protective shell each time said coupler is mated and unmated.

10. Apparatus according to claim 1 which includes:

(A) means for wiping the surfaces of said first and second core members which are in magnetic flux registration, each time said coupler is mated and unmated.

* * * * *